US011426999B2

(12) United States Patent
Tsutsui et al.

(10) Patent No.: US 11,426,999 B2
(45) Date of Patent: Aug. 30, 2022

(54) LIQUID DISCHARGE HEAD AND METHOD FOR PRODUCING LIQUID DISCHARGE HEAD

(71) Applicant: CANON KABUSHIKI KAISHA, Tokyo (JP)

(72) Inventors: Satoshi Tsutsui, Kanagawa (JP); Kazunari Ishizuka, Shizuoka (JP); Isamu Horiuchi, Kanagawa (JP); Yohei Hamade, Tokyo (JP); Miho Ishii, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/128,445

(22) Filed: Dec. 21, 2020

(65) Prior Publication Data

US 2021/0213738 A1 Jul. 15, 2021

(30) Foreign Application Priority Data

Jan. 10, 2020 (JP) ..... JP2020-003024

(51) Int. Cl.
*B41J 2/14* (2006.01)
*B41J 2/16* (2006.01)

(52) U.S. Cl.
CPC ..... *B41J 2/14145* (2013.01); *B41J 2/1433* (2013.01); *B41J 2/14201* (2013.01); *B41J 2/1606* (2013.01)

(58) Field of Classification Search
CPC .. B41J 2/14145; B41J 2/14201; B41J 2/1433; B41J 2/1606; B41J 2/1629; B41J 2/1645; B41J 2/1603; B41J 2/1628; B41J 2/1631; B41J 2/1639; B41J 2/1646
See application file for complete search history.

(56) References Cited

U.S. PATENT DOCUMENTS 8,481,249 B2 7/2013 Matsumoto et al.
8,741,549 B2 6/2014 Ishizuka

FOREIGN PATENT DOCUMENTS

JP 4881081 B2 * 2/2012 ..... B41J 2/1603
JP 2013-018272 A 1/2013

OTHER PUBLICATIONS

IP/com search (Year: 2022).*

* cited by examiner

*Primary Examiner* — Lisa Solomon
(74) *Attorney, Agent, or Firm* — Venable LLP

(57) ABSTRACT

A liquid discharge head is provided which has a substrate, a flow channel forming member provided on a substrate surface of the substrate and forming a flow channel of a liquid, and a discharge port forming member provided on the flow channel forming member and having a discharge port through which a liquid is discharged, wherein the discharge port forming member and the flow channel forming member are formed of materials different from each other, a thickness of the flow channel forming member is greater than a thickness of the discharge port forming member in a direction perpendicular to the substrate surface, the discharge port forming member is a cured product of a photosensitive resin composition, and the flow channel forming member contains at least one resin selected from the group consisting of a polyether amide resin, a polyether imide resin and a polyether amide-imide resin.

10 Claims, 5 Drawing Sheets

LIQUID DISCHARGE HEAD AND METHOD FOR PRODUCING LIQUID DISCHARGE HEAD

BACKGROUND OF THE INVENTION

Field of the Invention

The present invention relates to a liquid discharge head and a method for producing a liquid discharge head.

Description of the Related Art

A liquid discharge head used in liquid discharge devices, such as inkjet recording devices, has a flow channel forming member and a substrate. The flow channel forming member is provided on the substrate, and forms a flow channel of the liquid. A liquid feeding port is formed in the substrate, and an energy generating element is provided on the front surface side of the substrate.

A liquid is supplied to the flow channel from the liquid feeding port, is imparted with energy by the energy generating element, is discharged through a liquid discharge port of a discharge port forming member provided on the flow channel forming member, and lands on a recording medium, such as paper.

Further, on the substrate an insulating layer or a protective layer is provided to cover the energy generating element, and alternatively, an inorganic material layer is often provided for various other purposes. Meanwhile, forming from an organic material layer a flow channel forming member and other structures on a substrate is known. In particular, when the organic material layer is formed from a photosensitive resin, the organic material layer having high precision can be formed by photolithography.

For instance in the method for producing a liquid discharge head disclosed in Japanese Patent Application Publication No. 2013-018272, a dry film of a photosensitive resin layer that constitutes a liquid flow channel is formed, by a lamination method, on a substrate having an inorganic material layer, and is exposed to yield the shape of the flow channel. Next, a dry film of a photosensitive resin layer that constitutes discharge ports and nozzle portions that connect the discharge ports and the flow channels is laminated on the photosensitive resin layer that constitutes the flow channel, and is exposed to yield discharge port shapes, and then the uncured portions of the respective photosensitive resin layers are collectively removed by developing, to thereby form a flow channel, nozzle portions and discharge ports.

SUMMARY OF THE INVENTION

The present disclosure is a liquid discharge head that has: a substrate; a flow channel forming member provided on a substrate surface of the substrate and forming a flow channel of a liquid; and a discharge port forming member provided on the flow channel forming member and having a discharge port through which a liquid is discharged, wherein the discharge port forming member and the flow channel forming member are formed of materials different from each other; a thickness of the flow channel forming member is greater than a thickness of the discharge port forming member in a direction perpendicular to the substrate surface; the discharge port forming member is a cured product of a photosensitive resin composition; and the flow channel forming member contains at least one resin selected from the group consisting of a polyether amide resin, a polyether imide resin and a polyether amide-imide resin.

The present disclosure is also a method for producing a liquid discharge head including a substrate, a flow channel forming member provided on a substrate surface of the substrate and forming a flow channel of a liquid, and a discharge port forming member provided on the flow channel forming member and having a discharge port through which the liquid is discharged, the method including: forming, on the substrate, a flow channel forming member that forms a flow channel of a liquid; and forming, on the flow channel forming member, a discharge port forming member having a discharge port through which a liquid is discharged, wherein the discharge port forming member and the flow channel forming member are formed of materials different from each other; a thickness of the flow channel forming member is greater than a thickness of the discharge port forming member in a direction perpendicular to the substrate surface; the discharge port forming member is a cured product of a photosensitive resin composition; and the flow channel forming member contains at least one resin selected from the group consisting of a polyether amide resin, a polyether imide resin and a polyether amide-imide resin.

Further features of the present invention will become apparent from the following description of exemplary embodiments with reference to the attached drawing.

DESCRIPTION OF THE EMBODIMENTS

Figure 1A:
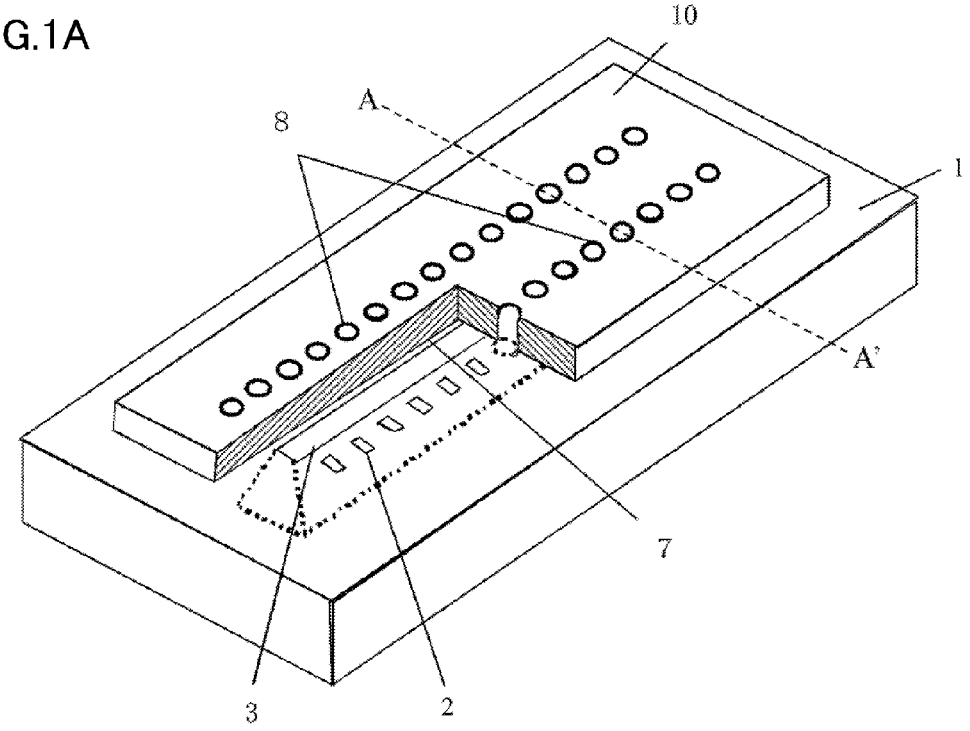
FIG. 1A is a schematic perspective diagram illustrating an example of the configuration of a liquid discharge head.

The increasing sophistication of requirements placed on inkjet image recording has been accompanied by ever more demanding requirements from the performance of inks; herein there are growing opportunities for adding high-boiling point solvents into inks, from the viewpoint of fixability to recording materials.

Ink types thus obtained may permeate into photosensitive resin layers made of epoxy resins or the like, thereby giving rise to deformation of a flow channel forming member.

It is therefore deemed that when using this type of ink in the configuration of Japanese Patent Application Publication No. 2013-018272, deformation of the flow channel forming member progresses at a higher pace than that in the case of conventionally used ink types; this leaves thus room for improvement in terms of long-term reliability.

For instance the flow channel forming member may peel off the substrate, and/or desired ink discharge performance may fail to be obtained, with prolonged used of an inkjet head.

The present disclosure provides a liquid discharge head, and a method for producing a liquid discharge head, that allow suppressing peeling of a flow channel forming member from a substrate, while ensuring high reliability, by preventing permeation of ink into the flow channel forming member even when using a highly permeable ink.

Embodiments for carrying out the present disclosure will be illustrated specifically below with reference to accompanying drawings. The dimensions, materials, shapes, relative arrangement positions and so forth of constituent parts described in the embodiments are to be modified as appropriate depending on the configuration of the members to which the invention is to be applied, and depending on various conditions. That is, the scope of the present disclosure is not meant to be limited to the embodiments below.

In the present disclosure, the notations "from XX to YY" and "XX to YY" representing a numerical range denote, unless otherwise stated, a numerical value range that includes the lower limit and the upper limit thereof, as endpoints.

In a case where numerical value ranges are described in stages, the upper limits and the lower limits of the respective numerical value ranges can be combined arbitrarily.

In the explanation below, features having identical functions are denoted in the drawings with identical reference symbols, and a recurrent explanation thereof may be omitted.

REFERENCE SYMBOLS IN THE DRAWINGS ARE AS FOLLOWS

1: substrate; 2: energy generating element; 3: feeding port; 4: inorganic material layer; 5: protective layer; 6: flow channel forming member; 7: flow channel; 8: discharge port; 9: nozzle portions; 10: discharge port forming member; 11: liquid repellent layer; 12: film; 13: flow channel forming member resin; 14: mask resist; 15: flow channel formation mask; 16: photosensitive resin composition; 17: discharge port formation mask; 18: photosensitive resin composition; 19: flow channel formation mask; and 20: substrate surface.

Figure 1B:
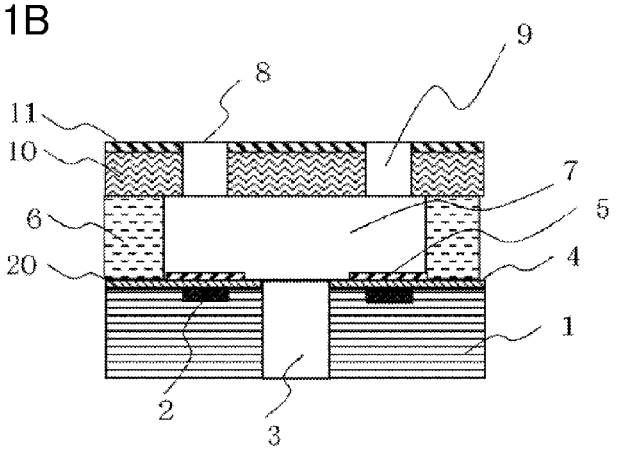
FIG. 1B is a schematic cross-sectional diagram along line A-A' in FIG. 1A.

FIG. 1A is a schematic perspective diagram illustrating an example of the configuration of a liquid discharge head. FIG. 1B is an embodiment in a schematic cross-sectional diagram of the liquid discharge head as viewed from a plane perpendicular to a substrate, and which passes through A-A' in FIG. 1A.

The liquid discharge head illustrated in FIGS. 1A and 1B has a substrate 1 in which energy generating elements 2 that generate energy for discharging a liquid are formed at a predetermined pitch. The substrate 1 is formed for instance of silicon.

Examples of the energy generating elements 2 include electro-thermal conversion elements and piezoelectric elements. The energy generating elements 2 may be provided so as to be in contact with the surface of the substrate 1, or may be provided as partially hollow shapes on the surface of the substrate 1. A control signal input electrode (not shown) for operating the energy generating elements 2 is connected to the energy generating elements 2. A feeding port 3 that supplies a liquid such as an ink is formed in the substrate 1.

An inorganic material layer 4 and a protective layer 5 are formed on the front surface side of the substrate 1. Examples of the substrate 1 include a silicon substrate formed of silicon. Preferably, the silicon substrate is silicon single crystal such that the crystal orientation of the surface thereof is (100). Examples of the inorganic material layer 4 include silicon oxide ($SiO_2$), silicon nitride (SiN), silicon carbide (SiC), silicon carbonitride (SiCN) and silicon oxycarbide (SiOC).

In FIGS. 1A and 1B the inorganic material layer 4 is used as a heat storage layer or insulating layer. The protective layer 5, which protects the energy generating elements, is formed for instance of Ta or Ir. The inorganic material layer 4 may cover the energy generating elements.

In FIGS. 1A and 1B the inorganic material layer 4 is formed substantially over the entire surface of the substrate 1 (substrate surface 20). On the inorganic material layer 4 a flow channel 7 is formed by a flow channel forming member 6 that forms a liquid flow channel and that is provided on the substrate surface 20 of the substrate 1. A discharge port forming member 10 provided on the flow channel forming member 6 and having discharge ports 8 for discharge of the liquid is further formed. The discharge port forming member 10 has liquid flow channels (nozzle portions 9) that communicate with the discharge ports 8. A liquid repellent layer 11 is formed on the discharge port forming member 10, as needed.

In this liquid discharge head, a liquid such as an ink that is supplied from the feeding port 3 through the flow channel 7 is acted upon by pressure generated by the energy generating elements 2, and is discharged as a result in the form of droplets from the discharge ports 8, via the nozzle portions 9.

A method for producing a liquid discharge head will be specifically illustrated next with reference to FIGS. 2A and 2B and FIGS. 3A to 3J.

Figure 2A:
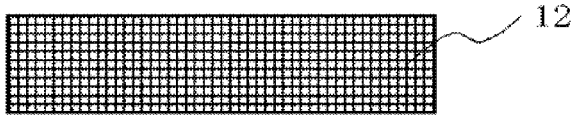
FIGS. 2A and 2B are schematic cross-sectional diagrams illustrating an example of a method for producing a resin structure.
Figure 2B:
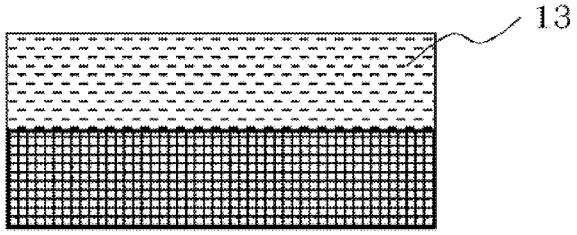

FIGS. 2A and 2B illustrate examples of a method for producing a resin structure that contains at least one resin selected from the group consisting of polyether amide resins, polyether imide resins and polyether amide-imide resins, and which forms the flow channel forming member.

FIGS. 3A to 3J are schematic cross-sectional diagrams illustrating an example of a method for producing a liquid discharge head. An example of a method for producing an inkjet head will be illustrated herein. FIGS. 3A to 3J illustrate cross-sectional structures in a completed state, as viewed on a plane perpendicular to the surface, similarly to FIG. 1B.

A film 12 made up of polyethylene terephthalate (PET) or a polyimide is prepared first, as illustrated in FIG. 2A. Next, as illustrated in FIG. 2B, at least one resin (flow channel forming member resin 13) selected from the group consisting of polyether amide resins, polyether imide resins and polyether amide-imide resins, is applied onto the film 12.

The application method may be for instance spin coating or slit coating. After application, the flow channel forming member resin 13 is pre-baked, to thereby produce a resin structure having the flow channel forming member resin 13.

Preferably, the at least one resin (flow channel forming member resin 13) selected from the group consisting of polyether amide resins, polyether imide resins and polyether amide-imide resins is a thermoplastic resin, from the viewpoint of bringing out high heat resistance and high adhesion.

The weight-average molecular weight (Mw) of the polyether amide resin, polyether imide resin or polyether amide-imide resin is preferably 5000 to 100000, more preferably 20000 to 50000.

Preferably, the weight-average molecular weight (Mw) of the polyether amide resin, the polyether imide resin or the polyether amide-imide resin is not more than 100000, from the viewpoint of resolution and solubility in solvents. On the other hand, the weight-average molecular weight (Mw) is preferably at least 5000, from the viewpoint of coatability and film properties.

Polyether amide resins, polyether imide resins and polyether amide-imide resins exhibit good processability, and low water absorption for instance towards liquids, and accordingly are suitable for being used as the flow channel forming member of the liquid discharge head.

Preferably, the water absorption rate of the polyether amide resin, polyether imide resin and polyether amide-imide resin is lower than the water absorption rate of a cured product of a photosensitive resin composition.

The thickness of the flow channel forming member is designed to be larger than the thickness of the discharge port forming member, in a direction perpendicular to the substrate surface 20. A good discharge characteristic is obtained as a result in that for instance droplets other than main droplets can be reduced at the time of discharge.

The thickness of the flow channel forming member resin 13 corresponds to the height of the flow channel in a direction perpendicular to the substrate surface 20. The thickness of the flow channel forming member resin 13 may be established as appropriate, through discharge design of the liquid discharge head, so as to be larger than the thickness of the discharge port forming member, but is preferably set to lie in the range of 3.0 μm to 25.0 μm. More preferably, the thickness of the flow channel forming member is set to 5.0 μm to 24.0 μm.

A concrete production method is explained below, but the invention is not limited thereto.

Figure 3A:
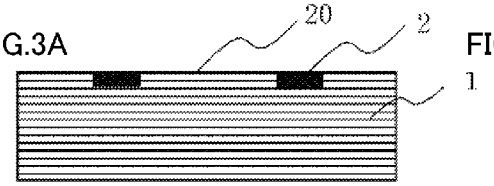
FIGS. 3A to 3J are schematic cross-sectional diagrams illustrating an example of a method for producing a liquid discharge head.

As illustrated in FIG. 3A, the substrate 1 is prepared that has the energy generating elements 2 on the front face side thereof (substrate surface 20 side).

Figure 3B:
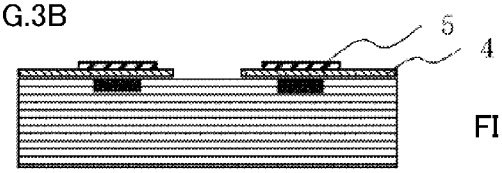

Next, as illustrated in FIG. 3B, the inorganic material layer 4 is formed on the front face side (on the substrate surface) of the substrate 1, so as to cover the energy generating elements 2. The protective layer 5 is formed above the energy generating elements 2. The inorganic material layer 4 and the protective layer 5 undergo patterning, as needed.

Figure 3C:
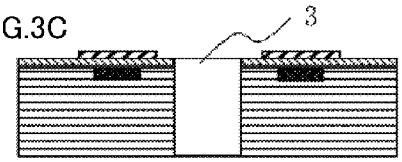

Next, as illustrated in FIG. 3C, the substrate is pierced, to form a feeding port 3 through which ink is supplied. The feeding port 3 is formed at a desired position, by wet etching using an alkaline etching solution such as tetramethylammonium hydroxide (TMAH), or by dry etching such as reactive ion etching.

Figure 3D:
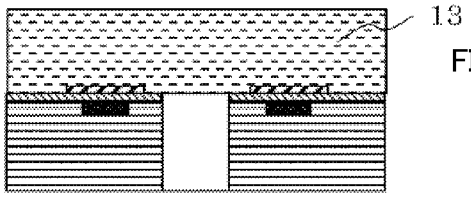

Film formation is performed next, as illustrated in FIG. 3D, in that the resin structure having the flow channel forming member resin 13 and explained in FIGS. 2A and 2B is transferred, by lamination, onto the inorganic material layer 4 of the substrate 1 in which the energy generating elements 2 and the feeding port 3 are disposed. Thereafter, the film 12 is stripped off the resin structure having the flow channel forming member resin 13, for instance by means of a peeling tape.

In the case of a substrate not having the feeding port 3 disposed therein, film formation may be accomplished by applying the flow channel forming member resin 13 by spin coating or slit coating, without using the above resin structure.

Figure 3E:
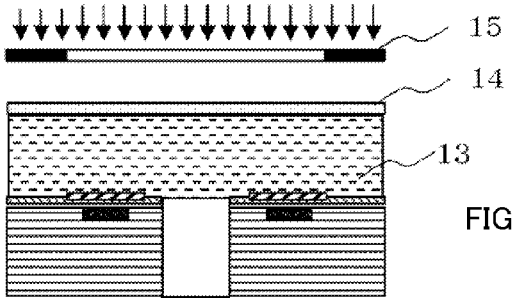

Next, as illustrated in FIG. 3E, a mask resist 14 is applied on the flow channel forming member resin 13, and pattern exposure is performed via a flow channel formation mask 15 having a flow channel pattern, followed by developing, to thereby form an etching mask.

Figure 3F:
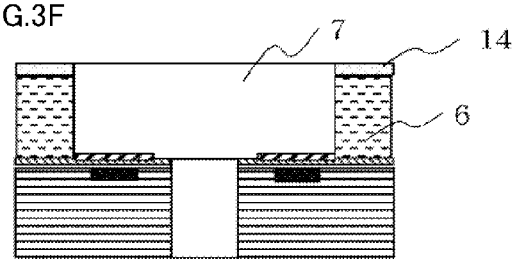

Next, as illustrated in FIG. 3F, patterning is carried out using oxygen plasma or the like, to form as a result the flow channel forming member 6 and the flow channel 7 of the liquid discharge head. The etching mask have become now unnecessary is removed for instance by means of a stripping solution.

Figure 3G:
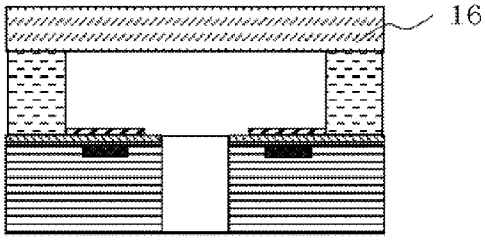

Next, as illustrated in FIG. 3G, a photosensitive resin composition 16 is applied on a film made up of PET, a polyimide or the like, followed by transfer onto the flow channel forming member 6, by lamination, to perform thus film formation.

The photosensitive resin composition 16 that constitutes the discharge port forming member 10 preferably contains an epoxy resin of cationic polymerization type, for instance in terms of adhesiveness, mechanical strength and resolution of the flow channel forming member 6.

An instance can be envisaged in which the discharge port forming member as well utilizes at least one resin selected from the group consisting of polyether amide resins, polyether imide resins and polyether amide-imide resins, similarly to the case of the flow channel forming member. In a case where a non-photosensitive resin is used from among the foregoing, however, resolution may in some instances be impaired due to processing by dry etching via a mask resist. Preferably, therefore, a photosensitive resin composition containing an epoxy resin of cationic polymerization type is used in the discharge port forming member.

Preferably, the photosensitive resin composition contains an epoxy resin of cationic polymerization type, for instance from the viewpoint of the adhesive performance and mechanical strength of the cured product of the composition, and from the viewpoint of for instance the reactivity and resolution of the composition as a photolithographic material.

The epoxy resin is preferably herein a thermosetting resin having a reactive epoxy group at terminals.

More preferably, the photosensitive resin composition contains a cationic polymerization-type epoxy resin having at least two epoxy groups in one molecule.

Preferably, the epoxy resin of cationic polymerization type is an epoxy resin of photocationic polymerization type. In that case, the photosensitive resin composition preferably contains a photoacid generator.

Concrete examples of epoxy resins of photocationic polymerization type include resin compositions that contain for instance a bisphenol A-type or F-type epoxy resin; a phenol novolac-type epoxy resin; a cresol novolac-type epoxy resin; or a multifunctional epoxy resin having a norbornene skeleton, terpene skeleton, dicyclopentadiene skeleton or oxycyclohexane skeleton.

The above photosensitive resin composition is preferably a negative-type composition since in that case solubility towards a developing solution drops when the composition is exposed, and the exposed portion remains after development.

By containing a cationic polymerization-type epoxy resin having at least two epoxy groups in one molecule, the photosensitive resin composition is suitable for achieving desired characteristics through three-dimensional crosslinking of the cured product of the resin composition.

Examples of photoacid generators and polymerization initiators include sulfonic acid compounds, diazomethane compounds, sulfonium salt compounds, iodonium salt compounds and disulfone compounds.

The photoacid generator or the photopolymerization initiator may be used in the form of a mixture of at least two types thereof. The photosensitive resin composition may further contain a silane coupling agent, for the purpose of improving adhesive performance. To improve pattern resolution and adjust sensitivity (exposure dose necessary for curing), the photosensitive resin composition main contain for instance a sensitizer such as an anthracene compound, a basic substance such as an amine, or an acid generator for generating weakly acidic (pKa=−1.5 to 3.0) toluenesulfonic acid.

The thickness of the discharge port forming member in a direction perpendicular to the substrate surface 20 may be established as appropriate by discharge design of the liquid discharge head, but is preferably set to lie in the range of 3.0 μm to 25.0 μm, for instance from the viewpoint of mechanical strength. More preferably, the thickness of the discharge port forming member is set to 4.5 μm to 20.0 μm.

Figure 3H:
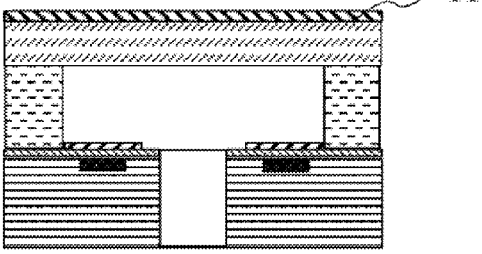

Next, as illustrated in FIG. 3H, a liquid repellent layer 11 is formed on the photosensitive resin composition 16.

Water absorption by the discharge port forming member can be reduced by forming the liquid repellent layer 11 on the discharge port forming member. The liquid repellent layer 11 is required to exhibit liquid repellency towards liquids such as ink; preferably, a cationically polymerizable perfluoroalkyl composition or perfluoropolyether composition is used herein as the liquid repellent layer 11. In the present disclosure the thickness of the liquid repellent layer is not added to the thickness of the discharge port forming member.

It is known that the alkyl fluoride chains of perfluoroalkyl compositions and perfluoropolyether compositions generally segregate at the interface between the resin composition and air as a result of baking after application of the resin composition; the liquid repellency of the surface of the composition can be accordingly increased as a result.

Figure 3I:
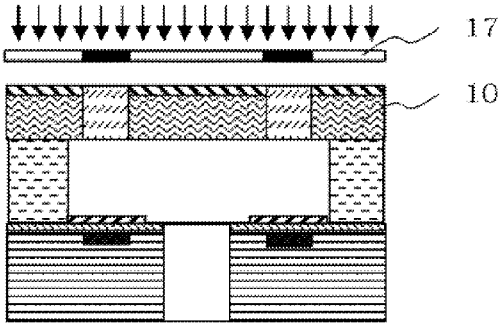

Next, as illustrated in FIG. 3I, the photosensitive resin composition 16 and the liquid repellent layer 11 are subjected to pattern exposure via a discharge port formation mask 17 having a discharge port pattern. Further, the exposed portion is cured as a result of a thermal treatment (post-exposure bake), to form the discharge port forming member 10.

The discharge port formation mask 17 is formed through formation of a light-shielding film such as a chromium film, in accordance with a pattern of the discharge ports, on a substrate made up of a material such as glass or quartz that transmits light of the exposure wavelength. As the exposure device there can be used a projection exposure device having a single-wavelength light source, such as an i-line exposure stepper or KrF stepper, or having a broad wavelength of a mercury lamp as a light source, such as a mask aligner MPA-600 Super (product name, by Canon Inc.).

Figure 3J:
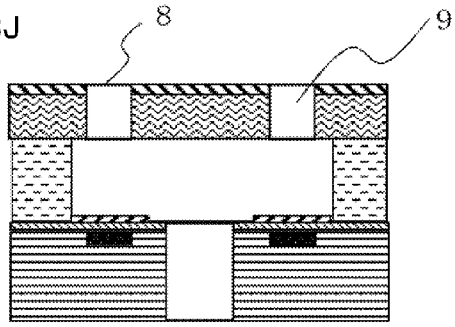

Next, as illustrated in FIG. 3J, the uncured portions of the photosensitive resin composition 16 and the liquid repellent layer 11 are collectively removed through developing using a developing solution, to form the discharge ports 8 and the nozzle portions 9, the liquid discharge head being then completed through a thermal treatment, as needed. Examples of the developing solutions include propylene glycol monomethyl ether acetate (PGMEA), methyl isobutyl ketone (MIBK) and xylene. Rinsing with isopropyl alcohol (IPA) or the like may be then carried out as the case may require.

EXAMPLES

The present disclosure will be explained in detail below with reference to examples and comparative examples, but the disclosure is not limited to the features that are implemented in these examples. The notation "parts" in the examples and comparative examples denote "parts by mass" unless otherwise specified.

Example 1

Figure 4A:
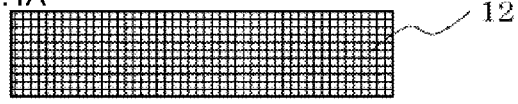
FIGS. 4A to 4L are schematic cross-sectional diagrams illustrating an example of a method for producing a liquid discharge head.

Firstly, as illustrated in FIG. 4A, there were prepared a PET film 12 having a thickness of 100 μm.

Figure 4B:
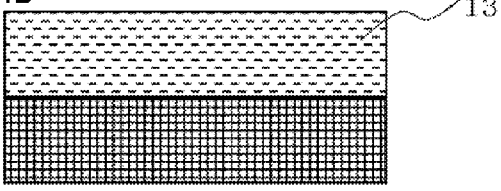

Next, as illustrated in FIG. 4B, HIMAL HL-1200CH (product name) by Hitachi Chemical Co., Ltd., which is a polyether amide resin (reference symbol 13 in FIG. 4B), was applied onto the PET film 12 by spin coating, followed by volatilization of the solvent by baking at 120° C. for 20 minutes, to thereby form a film having a thickness of 5.0 μm.

Figure 4C:
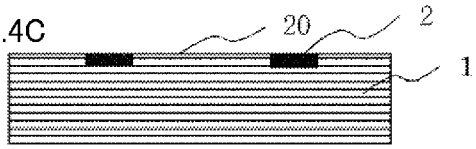

As illustrated in FIG. 4C, a substrate 1 formed of silicon and having energy generating elements 2 made of TaSiN on a front surface side (substrate surface 20 side) was prepared next.

Figure 4D:
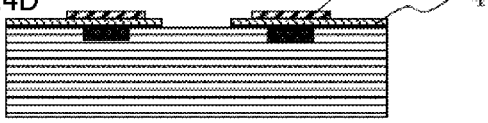

Then, as illustrated in FIG. 4D, a SiCN film was formed to a thickness of 0.3 μm as the inorganic material layer 4, by plasma CVD, on the front surface side of the substrate 1, so as to cover the energy generating elements 2. Next Ta was formed as the protective layer 5, to a thickness of 0.25 μm, by sputtering. The inorganic material layer 4 and the protective layer 5 were then patterned in a photolithography process and by reactive ion etching.

Figure 4E:
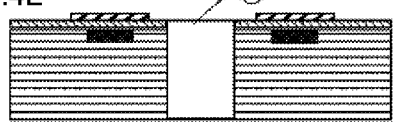

The feeding port 3 was formed next, as illustrated in FIG. 4E. The feeding port 3 was formed by forming an etching mask having an opening, using a positive-type photosensitive resin made up of THMP-iP5700HP (by Tokyo Ohka Kogyo Co., Ltd.), and by performing then reactive ion etching through the opening of the etching mask. Reactive ion etching was carried out in accordance with the Bosch process, using an ICP etching apparatus (by Alcatel Micro Machining Systems, model number: 8E). Once the feeding port 3 was formed, the etching mask was thereafter removed using a stripping solution.

Figure 4F:
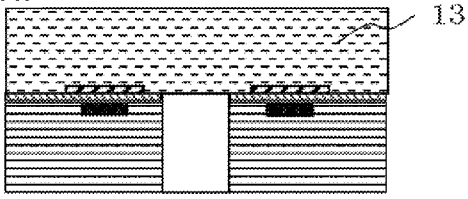

A polyether amide resin layer (reference symbol 13 in FIG. 4F) was formed next, as illustrated in FIG. 4F. Specifically, the PET film having the polyether amide resin produced in FIG. 4B was transferred by lamination, while under pressing and heating at 70° C., onto the substrate 1 in which there were disposed the energy generating elements 2 and the feeding port 3. The PET film 12 was thereafter stripped off the polyether amide resin using a peeling tape (not shown).

Figure 4G:
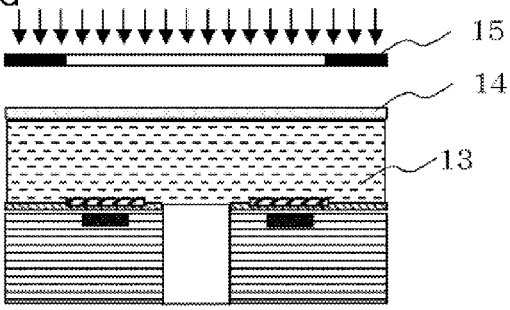

Next, as illustrated in FIG. 4G, THMP-iP5700HP (by Tokyo Ohka Kogyo Co., Ltd.) was applied, as the mask resist 14, from above flow channel forming member resin 13 made up of a polyether amide resin, followed by pattern exposure via the flow channel formation mask 15 having a flow channel pattern, and by developing, to form an etching mask as a result.

Figure 4H:
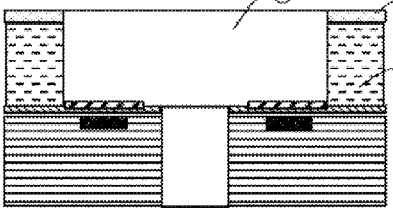

Next, as illustrated in FIG. 4H, reactive ion etching was performed through the opening of the etching mask, using an ICP etching device (by Alcatel Micro Machining Systems, model number: 8E), to thereby form the flow channel forming member 6 and the flow channel 7 of the liquid discharge head. Once the flow channel 7 was formed, the etching mask was thereafter removed using a stripping solution.

Figure 4I:
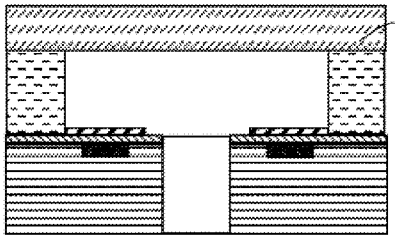

The photosensitive resin composition 16 was formed next, as illustrated in FIG. 4I.

Firstly, the photosensitive resin composition 16 made up of the composition materials given in Table 1 below was applied onto a PET film having a thickness of 100 μm, followed by volatilization of the solvent by baking at 90° C. for 20 minutes, to thereby form a film having a thickness of 4.5 μm.

Next, the photosensitive resin composition 16 was transferred and overlaid by lamination, while being heated at 50° C., onto the flow channel forming member 6 made up of the polyether amide resin 13.

TABLE 1

| Composition material | Product name | Parts by mass |
|---|---|---|
| Epoxy resin | jER157S70 | 100 |
| Photoacid generator | CPI-410S | 0.5 |
| Silane coupling agent | A-187 | 5 |
| Solvent | PGMEA | 140 |

The table includes the following.

jER157S70: by Mitsubishi Chemical Corporation

CPI-410S: by San-Apro Ltd.

A-187: by Momentive Performance Materials Inc.

PGMEA: 2-methoxy-1-methylethyl acetate

Figure 4J:
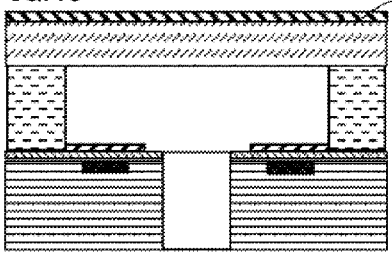

The liquid repellent layer 11 was formed next as illustrated in FIG. 4J. As a fluorine-containing compound that formed the liquid repellent layer there was used a product resulting from diluting, in 2-butanol and ethanol, a condensate of a composition made up of the compound represented by Formula (1) below, glycidylpropyltriethoxysilane and methyltriethoxysilane. The above fluorine-containing compound was applied onto the photosensitive resin composition 16 by slit coating, and a thermal treatment was carried out at 70° C. for 3 minutes, to thereby volatilize the diluting solvent, and form the liquid repellent layer 11 having a thickness of 0.5 μm on the photosensitive resin composition 16.

(1)

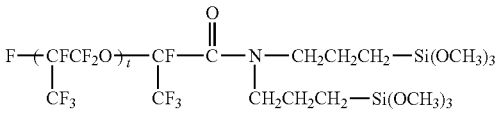

(In Formula (1), t is an integer of 3 to 10.)

Figure 4K:
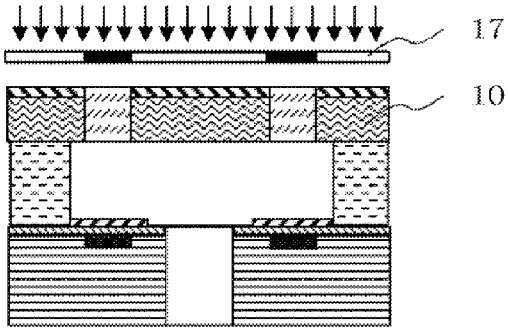

Next, as illustrated in FIG. 4K, the photosensitive resin composition 16 and the liquid repellent layer 11 were subjected to pattern exposure, at an exposure dose of 1100 J/m$^2$ using an i-ray exposure stepper (by Canon Inc., product name: i5), via the discharge port formation mask 17 having a discharge port pattern. The exposed portion was then cured by performing a thermal treatment at 90° C. for 5 minutes, to thereby form the discharge port forming member 10.

Figure 4L:
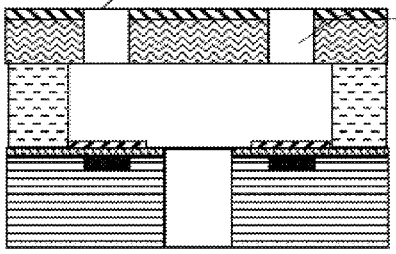

Next, as illustrated in FIG. 4L, the uncured portions of the photosensitive resin composition 16 and of the liquid repellent layer 11 were removed by developing for 10 minutes with propylene glycol monomethyl ether acetate (PGMEA). The discharge ports 8 and the nozzle portions 9 were formed as a result, and were then cured by heat at 200° C., to yield a liquid discharge head.

Example 2

A liquid discharge head was produced in the same way as in Example 1, but herein HIMAL HL-1210CH (product name) by Hitachi Chemical Co., which is a polyether amide-imide resin, was used in the flow channel forming member.

Comparative Example 1

A liquid discharge head was produced in the same manner as in the examples, but herein the flow channel forming member was formed using a photosensitive resin composition made up of the composition materials given in Table 2 below.

Figure 5A:
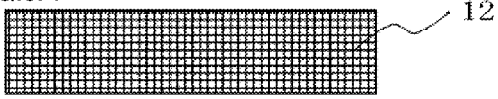
FIGS. 5A to 5L are schematic cross-sectional diagrams illustrating an example of a method for producing a liquid discharge head.

As illustrated in FIG. 5A, firstly there was prepared a PET film 12 having a thickness of 100 μm.

Figure 5B:
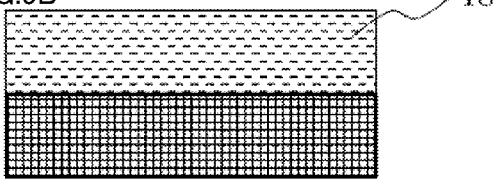

Next, as illustrated in FIG. 5B, a photosensitive resin composition 18 made of the composition materials given in Table 2 below was applied onto the PET film 12 having a thickness of 100 μm, and the solvent was volatilized by baking at 90° C. for 20 minutes, to thereby form a film having a thickness of 5.0 μm.

Figure 5C:
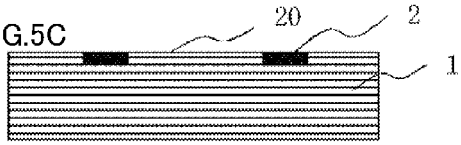
Figure 5D:
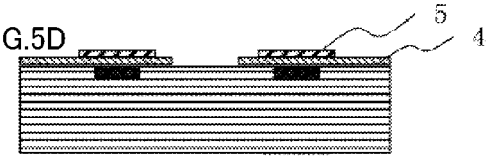
Figure 5E:
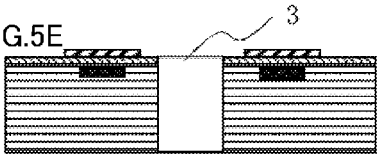

A substrate having the feeding port 3 was then produced, as illustrated in FIGS. 5C to 5E, in accordance with the same method as in Example 1.

Figure 5F:
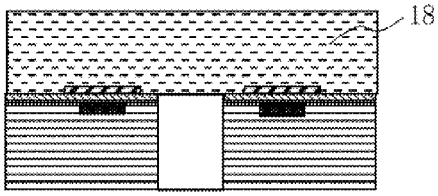

Next, as illustrated in FIG. 5F, the PET film having the photosensitive resin composition 18 produced in FIG. 5B was transferred by lamination, while under pressing and heating at 70° C., onto the substrate 1 in which the energy generating elements 2 and the feeding port 3 were disposed. The PET film 12 was thereafter stripped off the photosensitive resin composition 18 using a peeling tape (not shown).

Figure 5G:
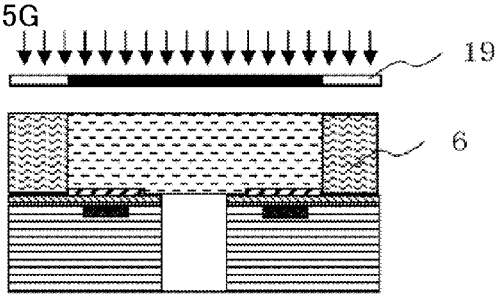

Next, as illustrated in FIG. 5G, the photosensitive resin composition 18 was subjected to pattern exposure, at an exposure dose of 4000 J/m$^2$ using an i-ray exposure stepper (by Canon Inc., product name: i5), via a flow channel formation mask 19 having a flow channel pattern. The exposed portion was cured by performing a thermal treatment at 90° C. for 5 minutes, to thereby form a side wall that constituted the flow channel forming member 6.

Figure 5H:
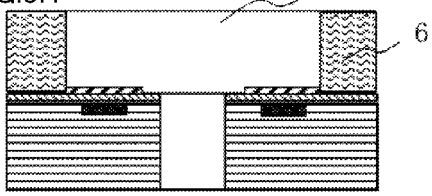

Next, as illustrated in FIG. 5H, the uncured portion of the photosensitive resin composition 18 was removed by developing for 10 minutes with propylene glycol monomethyl ether acetate (PGMEA), to form the flow channel forming member 6 and the flow channel 7.

Figure 5I:
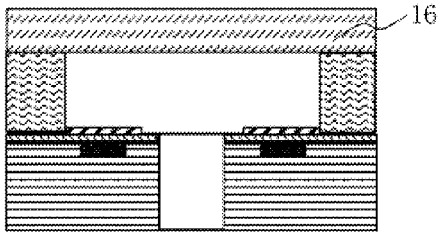

The photosensitive resin composition 16 was formed next, as illustrated in FIG. 5I.

Firstly, a photosensitive resin composition 16 made up of the composition materials given in Table 1 above was applied onto a PET film having a thickness of 100 μm, followed by volatilization of the solvent by baking at 90° C. for 20 minutes, to thereby form a film having a thickness of 4.5 μm.

Next, the photosensitive resin composition 16 was transferred and overlaid by lamination, while being heated at 50° C., onto the flow channel forming member 6 made up of the photosensitive resin composition 18.

Figure 5J:
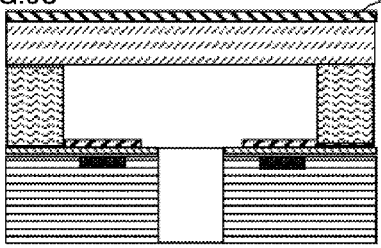
Figure 5K:
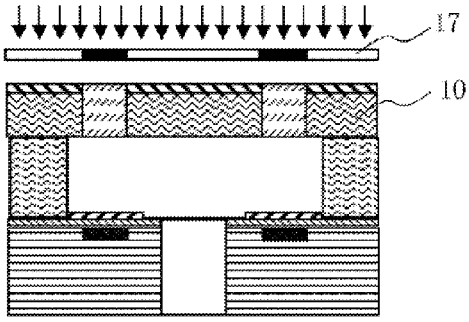
Figure 5L:
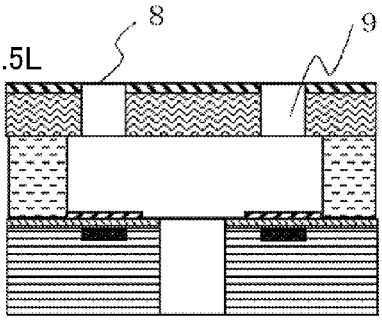

FIGS. 5J to 5L hereafter are identical to those of the above examples.

TABLE 2

| Composition material | Product name | Parts by mass |
|---|---|---|
| Epoxy resin | TECHMORE VG3101 | 100 |
| Photoacid generator | SP-172 | 6 |
| Silane coupling agent | A-187 | 5 |
| Solvent | PGMEA | 100 |

The table includes the following.

TECHMORE VG3101: by Printec Co.

SP-172 ADEKA Optomer SP-172 by ADEKA Corporation

A-187: by Momentive Performance Materials Inc.

PGMEA: 2-methoxy-1-methylethyl acetate

Evaluation

Water Absorption Rate

The water absorption rate of each cured product of the resins and the photosensitive resin compositions described in Examples 1 and 2 and Comparative example 1 was evaluated in accordance with the following method.

Firstly, HIMAL HL-1200CH (product name: polyether amide resin) by Hitachi Chemical Co., Ltd. and HIMAL HL-1210CH (product name: polyether amide-imide resin) by Hitachi Chemical Co., Ltd., used in Examples 1 and 2, were applied onto a silicon substrate. After application solvent was volatilized by baking at 120° C. for 20 minutes, to form a 5 μm film.

As for the cured product of the photosensitive resin composition used in Comparative example 1, exposure and a thermal treatment were performed under the same conditions as in the method for forming the flow channel forming member of Comparative example 1, to thereby produce a cured product of the photosensitive resin composition 18.

Thereafter, the substrates on which the cured products of the respective resins were formed were immersed in pure water at 70° C. for one day, and the mass change of the cured product of each resin before and after immersion in pure water was measured using a mass spectrometer (by Metryx Ltd., product name: Mentor OC23). The measurement results of water absorption rate are given in Table 3. The water absorption rate of each product prepared in Examples 1 and 2 was significantly lower than that of the comparative example.

TABLE 3

| | Water absorption rate |
|---|---|
| Example 1 | 0.07% |
| Example 2 | 0.09% |
| Comparative example 1 | 0.53% |

Ink Resistance

The flow channels of the respective liquid discharge heads prepared in Examples 1 and 2 and Comparative example 1 were filled with the ink given in Table 4 below, and the liquid discharge heads were allowed to stand in an oven at 70° C. for 90 days.

TABLE 4

| Formulation | Parts by mass |
|---|---|
| Diethylene glycol | 10.0 |
| 2-Pyrrolidone | 5.0 |
| 1,2-Hexanediol | 7.0 |
| Triethylene glycol monobutyl ether | 25.0 |
| Acetylenol | 1.0 |
| Black pigment | 3.0 |
| Pure water | 49.0 |

The joint state between the inorganic material layer 4 and the flow channel forming member 6 after being allowed to stand was observed under a metallurgical microscope, and an evaluation was carried out according to the criteria below. Evaluation results of ink resistance are given in Table 5.

In the liquid discharge heads produced in Examples 1 and 2, no peeling was observed between the inorganic material layer and the flow channel forming member, and ink resistance was good; in the comparative example, by contrast, partial peeling was observed between the inorganic material layer and the flow channel forming member.

Evaluation Criteria

A: No peeling between the inorganic material layer 4 and the flow channel forming member 6 even after storage at 70° C. for 90 days.

B: Peeling that was not observed upon completion of the liquid discharge head does occur between the inorganic material layer 4 and the flow channel forming member 6 after storage at 70° C. for 90 days.

TABLE 5

| | Ink resistance |
|---|---|
| Example 1 | A |
| Example 2 | A |
| Comparative example 1 | B |

Print Evaluation

Each liquid discharge head produced in the examples and comparative examples was filled with the same ink as that for ink resistance evaluation, and a print evaluation after storage at 70° C. for 90 days was carried out. Print evaluation results are given in Table 6.

The liquid discharge heads produced in Examples 1 and 2 were evaluated with good ratings, whereas in the comparative example partial peeling occurred between the inorganic material layer and the flow channel forming member, with observable impairment of print quality.

TABLE 6

| | Print evaluation |
|---|---|
| Example 1 | Good |
| Example 2 | Good |
| Comparative example 1 | Decrease |

As described above, the present invention succeeded in providing a liquid discharge head that allows suppressing peeling of a flow channel forming member from a substrate, while ensuring high reliability, by preventing permeation of ink into the flow channel forming member even when using a highly permeable ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-003024, filed Jan. 10, 2020, which is hereby incorporated by reference herein in its entirety.

What is claimed is:

1. A liquid discharge head, comprising: a substrate; a flow channel forming member provided on a substrate surface of the substrate and forming a flow channel of a liquid; and a discharge port forming member provided on the flow channel forming member and having a discharge port through which the liquid is discharged, wherein:

the discharge port forming member and the flow channel forming member are formed of materials different from each other;

a thickness of the flow channel forming member is greater than a thickness of the discharge port forming member in a direction perpendicular to the substrate surface;

the discharge port forming member is a cured product of a photosensitive resin composition; and the flow channel forming member contains at least one resin selected from the group consisting of a polyether amide resin, a polyether imide resin and a polyether amide-imide resin.

2. The liquid discharge head according to claim 1, wherein the polyether amide resin, the polyether imide resin and the polyether amide-imide resin are thermoplastic resins.

3. The liquid discharge head according to claim 1, wherein a weight-average molecular weight of each of the polyether amide resin, the polyether imide resin and the polyether amide-imide resin is 5000 to 100000.

4. The liquid discharge head according to claim 1, wherein the photosensitive resin composition contains an epoxy resin of cationic polymerization type.

5. The liquid discharge head according to claim 1, wherein the photosensitive resin composition contains a cationic polymerization-type epoxy resin having at least two epoxy groups in one molecule.

6. The liquid discharge head according to claim 1, wherein the photosensitive resin composition is a negative-type composition.

7. The liquid discharge head according to claim 1, wherein the photosensitive resin composition contains a photoacid generator.

8. The liquid discharge head according to claim 1, wherein a water absorption rate of each of the polyether amide resin, the polyether imide resin and the polyether amide-imide resin is lower than a water absorption rate of the cured product of the photosensitive resin composition.

9. The liquid discharge head according to claim 1, wherein a liquid repellent layer is formed on the discharge port forming member.

10. A method for producing a liquid discharge head including a substrate, a flow channel forming member provided on a substrate surface of the substrate and forming a flow channel of a liquid, and a discharge port forming member provided on the flow channel forming member and having a discharge port through which the liquid is discharged, the method comprising:

forming, on the substrate, the flow channel forming member that forms the flow channel; and forming, on the flow channel forming member, the discharge port forming member having the discharge port, wherein:

the discharge port forming member and the flow channel forming member are formed of materials different from each other;

a thickness of the flow channel forming member is greater than a thickness of the discharge port forming member in a direction perpendicular to the substrate surface;

the discharge port forming member is a cured product of a photosensitive resin composition; and the flow channel forming member contains at least one resin selected from the group consisting of a polyether amide resin, a polyether imide resin and a polyether amide-imide resin.

* * * * *